US006895616B2

(12) United States Patent
Heimbrock

(10) Patent No.: US 6,895,616 B2
(45) Date of Patent: May 24, 2005

(54) EPIDURAL PATIENT SUPPORT

(75) Inventor: Richard H. Heimbrock, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 129 days.

(21) Appl. No.: 10/333,392

(22) PCT Filed: Jul. 24, 2001

(86) PCT No.: PCT/US01/23229

§ 371 (c)(1),
(2), (4) Date: Jan. 17, 2003

(87) PCT Pub. No.: WO02/09634

PCT Pub. Date: Feb. 7, 2002

(65) Prior Publication Data

US 2004/0074001 A1 Apr. 22, 2004

Related U.S. Application Data

(62) Division of application No. 09/911,685, filed on Jul. 24, 2001.

(60) Provisional application No. 60/221,101, filed on Jul. 27, 2000.

(51) Int. Cl.[7] ..... A47B 7/00

(52) U.S. Cl. ..... 5/600; 5/621; 5/624

(58) Field of Search ..... 5/600, 612, 615, 5/621–624; 600/415

(56) References Cited

U.S. PATENT DOCUMENTS

| | | | | |
|---|---|---|---|---|
| 2,577,177 A | | 9/1951 | Anderson | |
| 5,444,882 A | | 8/1995 | Andrews et al. | |
| 5,506,012 A | * | 4/1996 | Wright et al. | 428/35.2 |
| 5,577,503 A | * | 11/1996 | Bonutti | 600/415 |
| 5,754,997 A | | 5/1998 | Lussi et al. | |
| 6,324,710 B1 | | 12/2001 | Hernandez et al. | |

OTHER PUBLICATIONS

Hausted—The Gemini Series—A New line of specialty stretchers desinged for maximum versatility.

* cited by examiner

*Primary Examiner*—Michael F. Trettel
*Assistant Examiner*—Fredrick Conley
(74) *Attorney, Agent, or Firm*—Barnes & Thornburg LLP

(57) ABSTRACT

An epidural patient support includes an upper body support and a foot support. The upper body support extends outwardly from the patient support to support a patient's upper body with the patient's back arched forwardly. The foot support extends outwardly from the patient support to support the patient's feet. According to another illustrative embodiment, an epidural patient support is provided for placing a patient in a prone position for an epidural procedure with the patient's back arched upwardly.

16 Claims, 7 Drawing Sheets

EPIDURAL PATIENT SUPPORT

CROSS-REFERENCE TO RELATED APPLICATIONS

This application is a U.S. national counterpart application of international application Serial No. PCT/US01/23229 filed Jul. 24, 2001, which claims priority to U.S. provisional application Ser. No. 60/221,101 filed Jul. 27, 2000, and is a divisional application of co-pending U.S. utility application Ser. No. 09/911,685 filed Jul. 24, 2001.

BACKGROUND AND SUMMARY OF THE INVENTION

The present invention relates to patient supports, such as hospital beds and stretchers. More particularly, the present invention relates to patient supports configured to position a patient for receipt of a specific procedure, such as an epidural procedure.

Epidural procedures are most often applied to a patient in a hospital or a healthcare facility. The patient, therefore, is often already wearing a gown allowing access to the patient's back, and is lying on a hospital stretcher or a bed awaiting the procedure. An overbed tray or some other makeshift platform is sometimes used to support the patient's upper body and to properly expose the patient's back to apply the epidural procedure. This, however, can be cumbersome to use, and increases the level of discomfort to the patient while the epidural procedure is applied. Moreover, using movable hospital trays or other supports that are not secured during the administration of the procedure is not safe.

Accordingly, the present invention provides a patient support having an upper body support for supporting a patient's upper body during the administration of the epidural procedure. An illustrative patient support includes upper body and foot supports adjacent to one side of the patient support. The upper body support is movable between storage and use positions, and configured to support the upper body of the patient in the use position for an epidural procedure with the patient's back arched forwardly. The foot support is movable between storage and use positions, and configured to support a patient's feet while in the use position.

According to another embodiment, a patient support is provided for placing a patient in a prone position for an epidural procedure with the patient's back arched upwardly. Illustratively, the patient support includes a deck having a contoured portion. The contoured portion is movable between storage and use positions, and configured to raise the patient's back to a desired height in the use position.

Additional features of the present invention will become apparent to those skilled in the art upon a consideration of the following detailed description of the following embodiments exemplifying the best mode of carrying out the invention as presently perceived.

BRIEF DESCRIPTION OF THE DRAWINGS

The detailed description particularly refers to the accompanying drawings in which.

DETAILED DESCRIPTION OF THE DRAWINGS

Figure 1:
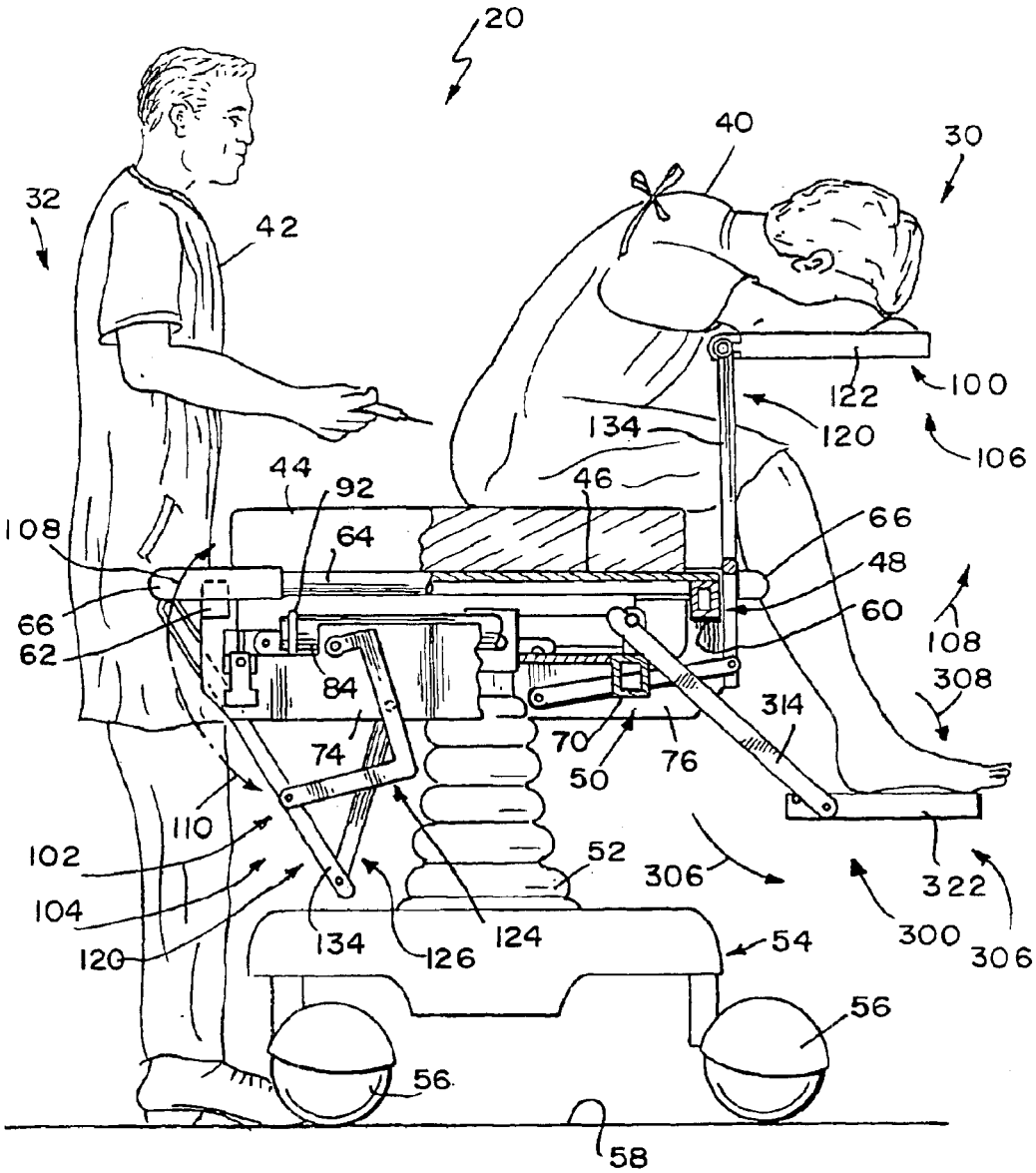
FIG. 1 is an end view of an illustrative epidural patient support having upper body and foot supports on both sides of the patient support, and showing a patient resting on the upper body support with the patient's back arched forwardly in a position to receive an epidural procedure and with the patient's feet supported on the foot support, and showing a caregiver preparing to administer the epidural procedure.

FIG. 1 shows an illustrative epidural patient support 20, such as a hospital bed or a stretcher. The patient support 20 includes an elongated first side 30, an elongated second side 32, a head end 34, a foot end 36, and a longitudinal axis 38. Each side 30, 32 of the patient support 20 includes an upper body support 100, 102 and a foot support 300, 302. In FIG. 1, a patient 40 is shown resting on the upper body support 100 with the patient's back arched forwardly in position to receive an epidural procedure and the patient's feet supported on the foot support 300. A caregiver 42 is shown preparing to administer the epidural procedure. The patient support 20 includes a mattress 44 supported on a deck 46 coupled to an upper frame 48. The upper frame 48 is, in turn, attached to an intermediate frame 50 which is supported on a pair of longitudinally spaced lifting mechanisms 52. The lifting mechanisms 52 are mounted on a base 54, which is supported by a plurality of casters 56 on a floor 58.

Coupled to the intermediate frame 50 are the upper body supports 100, 102 and the foot supports 300, 302. The patient 40 rests his head and arms on the upper body support 100 when the upper body support 100 is disposed in a raised outwardly extending use position 106. In addition, the patient 40 rests his feet on the foot support 300 when the foot support 300 is disposed in a lowered outwardly extending use position 306. When the patient 40 rests on the upper body support 100, he is forced to lean forward. The forward motion of the patient 40 exposes the patient's back allowing the caregiver 42 to perform the epidural procedure while the patient 40 is resting comfortably with his upper body and feet supported on the upper body and foot supports 100, 300 as shown in FIG. 1.

Figure 2:
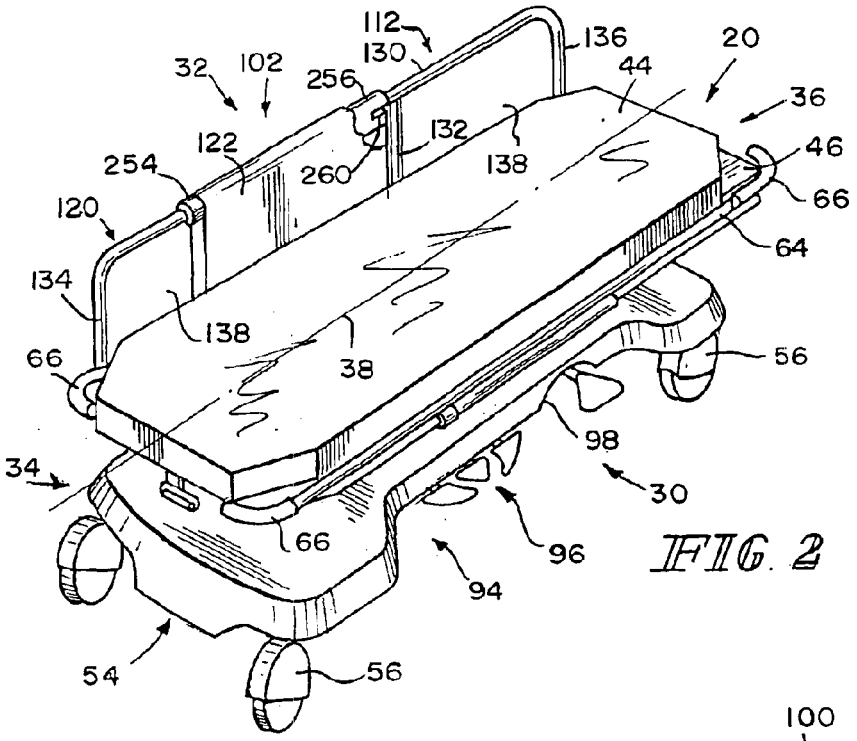
FIG. 2 is a perspective view of the patient support of FIG. 1 showing an upper body support on each side of the patient support, with the upper body support on the front side being shown in an out-of-the-way storage position and the upper body support on the rear side being shown in an intermediate use position.

The upper frame 48 includes two longitudinally extending side members 60, 62 and two transversely extending cross members (not shown). A bumper frame 64 is provided about the periphery of the mattress 44 as shown in FIG. 2. The bumper frame 64 includes corner bumpers 66 providing a gripping area for the caregiver 42 to grasp and maneuver the patient support 20 along the floor 58. The upper frame 48 and the bumper frame 64 are both attached to the intermediate frame 50, which has a smaller footprint than the frames 48 and 64 so as not to interfere with the caregivers as they work around the patient support 20.

The intermediate frame 50 includes two longitudinally extending side bars 70, 72 provided under the frames 48 and 64. Transversely extending end panels 74, 76 are attached to the ends 34, 36 of side bars 70, 72. Each end panel 74, 76 includes a cutout 78 at each end. Cross bars 84, 86 are attached transversely between the side bars 70, 72 by a pair of brackets 90, 92 mounted on the side bars 70, 72. The lifting mechanisms 52 each extend between one of the cross bars 84, 86 and the base 54.

As shown in FIG. 2, a recess 94 is formed in the base 54 to give the caregiver 42 better access to the patient 40 resting on the patient support 20. The base 54 includes a boot that encloses various frames and mechanisms. A plurality of foot pedals 96 extends outwardly from a lower edge 98 of the base 54. When engaged, the foot pedals 96 actuate the lifting mechanisms 52 to cause the deck 46 to raise, lower or tilt. The illustrative patient support 20 includes a conventional brake-steer mechanism (not shown). The brake-steer mechanism includes a caster braking mechanism which brakes the casters 56 to prevent the casters 56 from rotating and swiveling when a brake-steer shaft is rotated to a braking position. The brake-steer mechanism further includes a steering mechanism which lowers a center wheel into engagement with the floor 58 when the brake-steer shaft is rotated to a steering position. Additional details of a patient support of this type and various mechanisms can be found in U.S. Pat. No. 5,806,111, assigned to the same assignee as the present invention, which is herein incorporated by reference.

Figure 11:
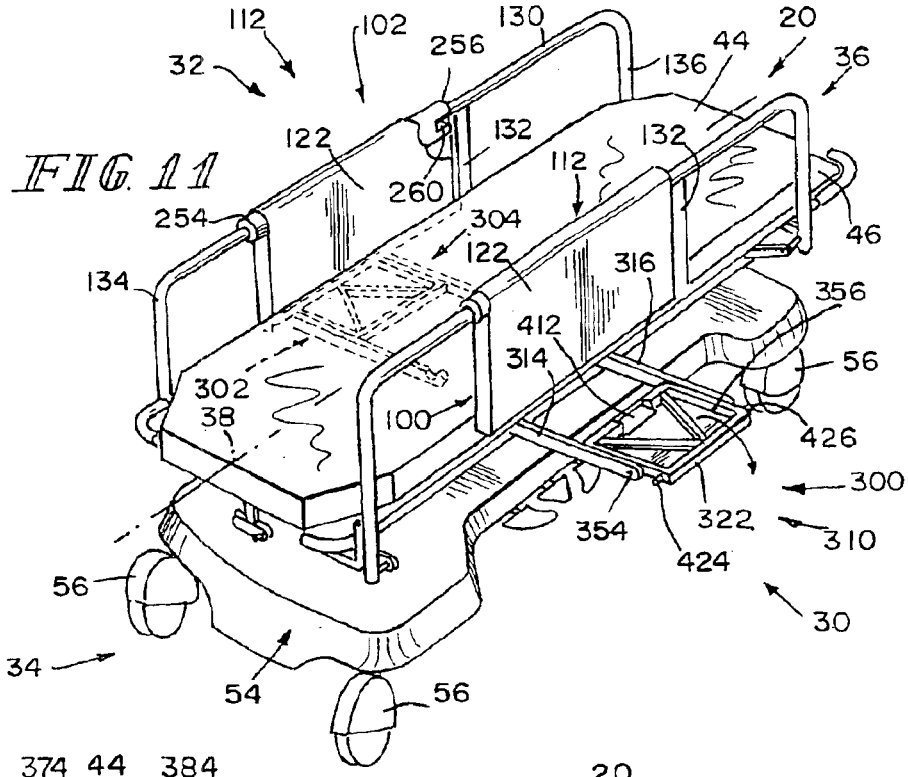
FIG. 11 is a perspective view of the patient support of FIG. 1 showing the upper body and foot supports on each side of the patient support, the upper body supports on both sides being shown in their respective intermediate use positions, the foot support on the front side being shown in an intermediate use position and the foot support on the rear side being shown, in broken lines, in an out-of-the-way storage position.

The illustrative epidural patient support 20 includes at least one upper body support 100. To provide better flexibility, however, an upper body support 100, 102 and a foot support 300, 302 are provided on each side 30, 32 of the patient support 20 as shown in FIGS. 1 and 11. The upper body supports 100, 102 are each movable between an out-of-the-way storage position 104 shown in FIG. 3 and a use position 106 shown in FIG. 1. Likewise, the foot supports 300, 302 are each movable between an out-of-the-way storage position 304 shown by broken lines in FIG. 11 and a use position 306 shown in FIG. 1. Moving the upper body supports 100, 102 and the foot supports 300, 302 to their respective out-of-the-way storage positions 104, 304 under the deck 46 allows the patient support 20 to additionally serve as a conventional patient support.

The upper body support 100 on the first side 30 of the patient support 20 will be described first. The construction and operation of the upper body support 102 on the second side 32 of the patient support 20 is similar. The upper body support 100 moves from the storage position 104 to the use position 106 along an arcuate path 108, and from the use position 106 to the storage position 104 along an arcuate path 110. As shown in FIGS. 1–4, the upper body support 100 includes a longitudinally extending frame 120, a swingable upper body support platform 122 pivotally mounted to the frame 120 and a structure comprising a generally J-shaped pivot link 124 and a hinge link 126 at each end 34, 36 of the frame 120 for pivotally coupling the frame 120 to the intermediate frame 50 of the patient support 20.

As shown in FIG. 2, the frame 120 includes a longitudinally extending bar 130, a pair of end bars 134, 136 extending perpendicularly from each end 34, 36 thereof and a coplanar brace 132 also extending perpendicularly from the bar 130 between the two end bars 134, 136. The longitudinally extending bar 130 and the end bars 134, 136 form an open space 138, as shown in FIG. 2, through which the patient 40 sitting on the deck 46 extends his feet as shown in FIG. 1. The longitudinally extending bar 130 is positioned above the mattress 44 when the upper body support 100 is either in the use position 106 shown in FIG. 1 or the intermediate use position 112 shown in FIG. 4 (collectively referred to as a raised position 106, 112).

Figure 3:
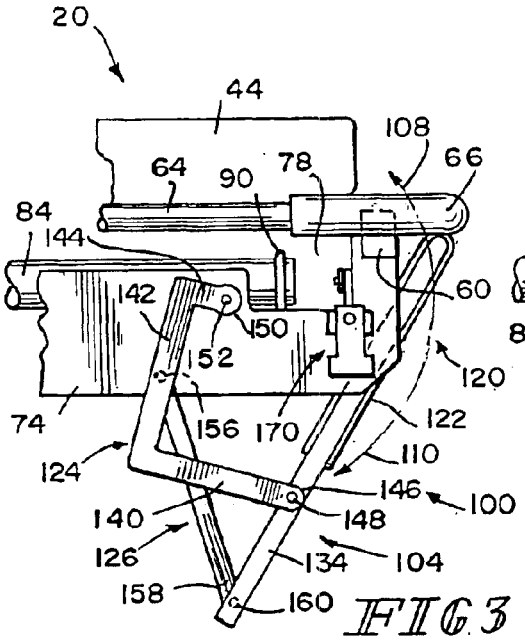
FIGS. 3 and 4 are partial end views of the patient support of FIG. 1 showing the upper body support in the storage and intermediate use positions respectively.
Figure 4:
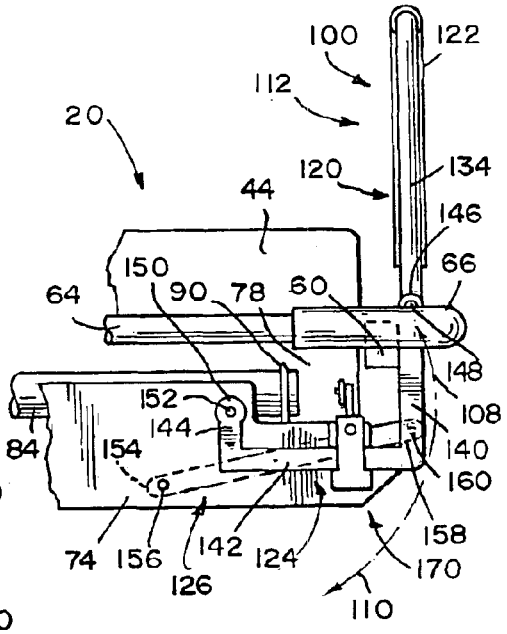

As shown in FIGS. 3 and 4, the J-shaped pivot link 124 comprises a first long portion 140, a second intermediate portion 142 and a third short portion 144. The free end 146 of the long portion 140 is connected to the outer wall of the end bar 134 of the frame 120 for pivotal movement about a transversely extending pin 148. The free end 150 of the short portion 144 is connected to the outer wall of the end panel 74 of the intermediate frame 50 for pivotal movement about a transversely extending pin 152. One end 154 of the hinge link 126 is attached to inner wall of the end panel 74 for pivotal movement about a transversely extending pin 156. The opposite end 158 of the hinge link 126 is attached to the inner wall of the end bar 134 for pivotal movement about a transversely extending pin 160. The J-shaped pivot link 124 pivots about the pins 148, 152 and the hinge link 126 pivots about the pins 156, 160 when the upper body support 100 moves along the arcuate paths 108, 110 between the storage position 104 shown in FIG. 3 and the raised position 106, 112 shown in FIGS. 1 and 4. The position of the upper body support 100 shown in FIG. 4 is referred to as the intermediate use position 112 since the platform 122 is shown in a downwardly extending stowed position 224, and not in a raised use position 226 shown in FIG. 1 where it extends generally horizontally from the longitudinally extending bar 130 to support the patient's upper body.

Figure 5:
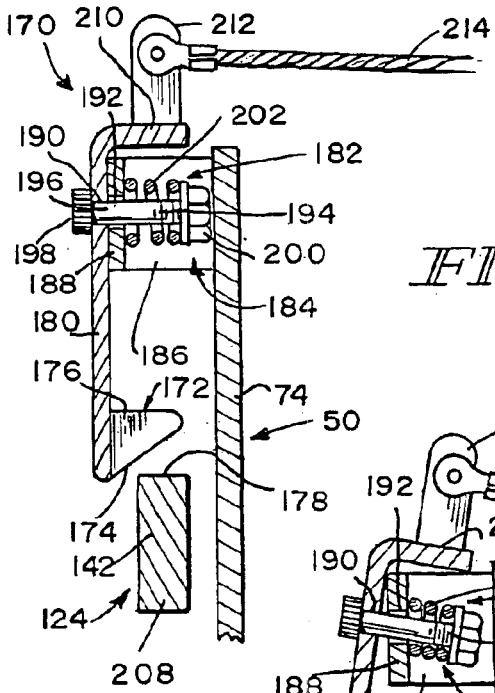
FIGS. 5, 6 and 7 are partial sectional end views of the patient support of FIG. 1 showing the operation of a latch assembly for the upper body support, FIG. 5 showing the upper body support in an unlatched position, FIG. 6 showing the upper body support engaging the latch as the upper body support is moved from the storage position in FIG. 3 to the intermediate use position in FIG. 4, and FIG. 7 showing the upper body support in a latched position.
Figure 6:
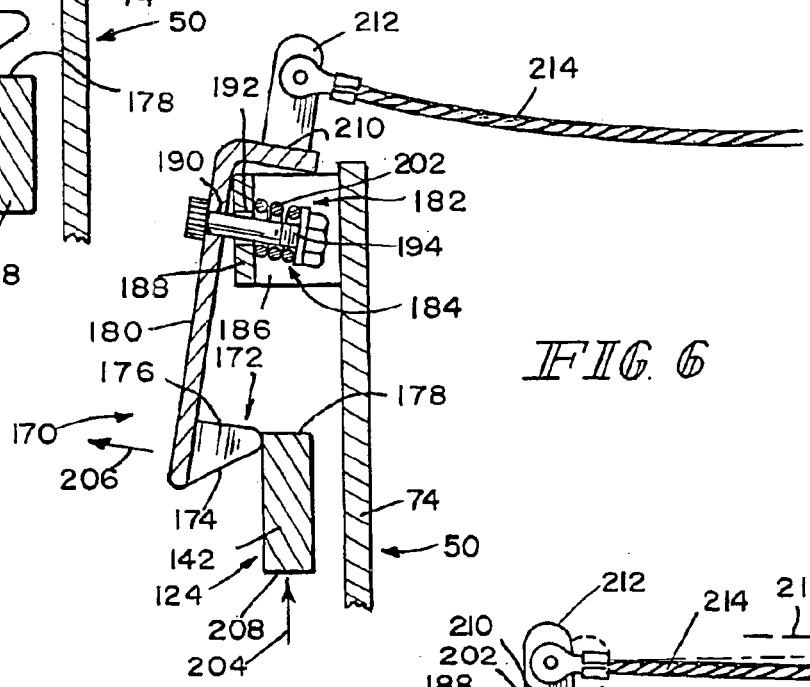
Figure 7:
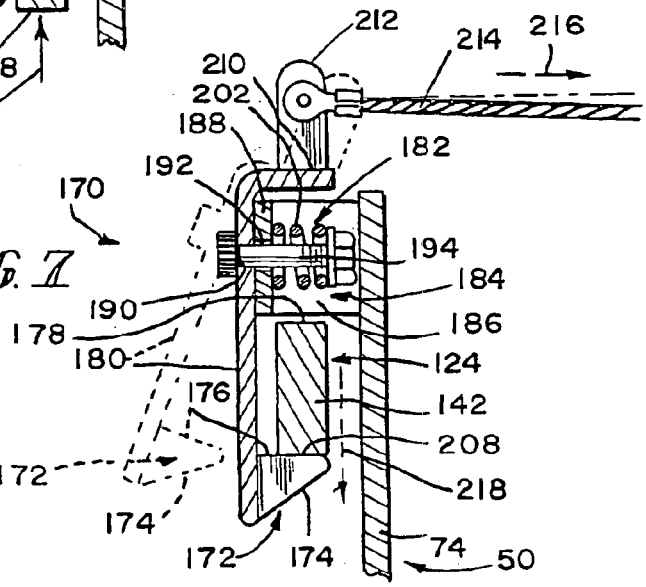

The upper body support 100 includes a latch assembly 170 to maintain the upper body support 100 in the raised position 106, 112. Referring to FIGS. 5–7, the latch assembly 170 includes a latch block 172 having an angled bottom surface 174 and a perpendicularly disposed top surface 176. A top edge 178 of the intermediate portion 142 of the J-shaped pivot link 124 engages the angled surface 174 of the latch block 172 as the upper body support 100 is moved along the arcuate path 108 toward the raised position 106, 112. The latch block 172 is attached to the inner surface of a spring-loaded latch plate 180. The latch plate 180 is movably coupled to the end panel 74 of the intermediate frame 50 by a joint assembly 182. The joint assembly 182 includes an angled bracket 184 comprising a first portion 186 attached to the outer surface of the end panel 74 and a second portion 188 appended substantially perpendicularly to the first portion 186. The latch plate 180 and the second portion 188 of the angled bracket 184 are formed to include coaxially disposed apertures 190, 192 through which a bolt 194 extends. The bolt 194 comprises a body 196, a cap 198 attached to the outer end of the body 196 and a bolt head 200 attached to the inner end of the body 196. A compression spring 202 is disposed around the body 196 between the bolt head 200 and the inner wall of the second portion 188 of the bracket 184.

As the upper body support 100 moves toward the raised position 106, 112, the intermediate portion 142 of the J-shaped pivot link 124 moves in direction 204 as shown in FIG. 6, and the top edge 178 of the intermediate portion 142, in engagement with the angled surface 174 of the latch block 172, pushes the latch block 172 and the latch plate 180 outwardly in direction 206. The outward movement of the latch plate 180 causes the bolt 194 to also move in direction 206 to compress the spring 202. As the intermediate portion 142 of the pivot link 124 continues to move upward in direction 204 in response to the movement of the upper body support 100 toward the raised position 106, 112, the compressed spring 202 keeps the latch block 172 pressed against the outer surface of the intermediate portion 142. Once the bottom edge 208 of the intermediate portion 142 clears the perpendicularly disposed top surface 176 of the latch block 172, the spring 202 causes the latch block 172 to snap back into its original position to lock the upper body support 100 in the raised position 106, 112 as shown in FIG. 7.

The latch plate 180 includes an angled portion 210 extending inwardly substantially perpendicularly from the top edge thereof. Attached to the top surface of the angled portion 210 is a bracket 212. One end of a pull cord 214 is attached to the bracket 212. When the pull cord 214 pulls the bracket 212 in direction 216, the latch plate 180 and the latch block 172 move in direction 206 as shown in broken lines in FIG. 7. When the latch block 172 clears the bottom edge 208 of the intermediate portion 142, the upper body support 100 is released to return to its lowered out-of-the-way storage position 104 shown in FIG. 3. Damping means may be provided to dampen the motion of the upper body support 100 as it returns to its out-of-the-way storage position 104. Conventional means, such as a latch, may be provided to lock the upper body support 100 in its storage position 104 to ensure that the upper body support 100 is stowed securely under the deck 46.

Figure 8:
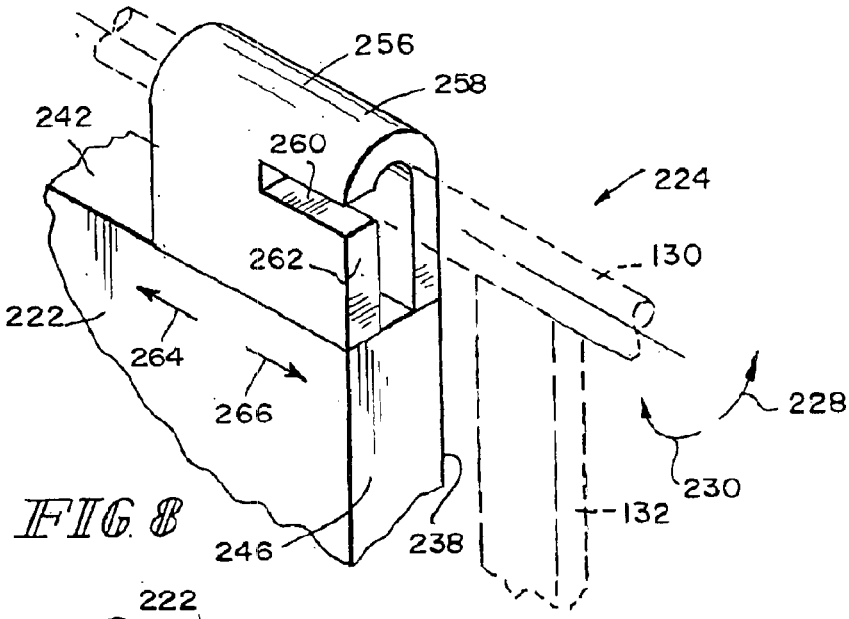
FIG. 8 is a partial perspective view of the upper body support platform in the downwardly extending storage position.
Figure 9:
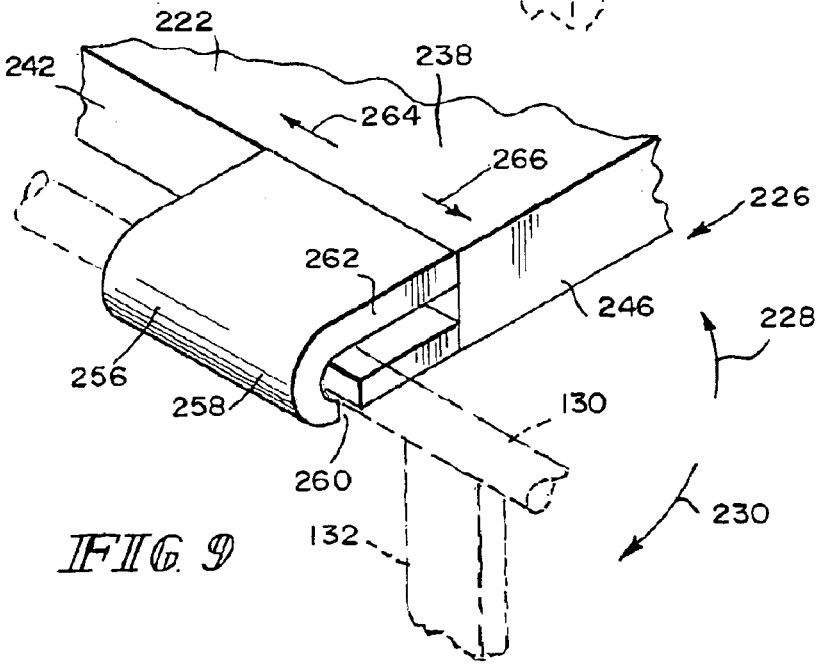
FIG. 9 is a partial perspective view of the upper body support platform in the horizontal outwardly extending use position.

When the upper body support 100 is in the intermediate use position 112 shown in FIG. 4, the upper body support platform 122 is movable between the stowed position 224 shown in FIG. 8 where the platform 122 extends generally downwardly from the longitudinally extending bar 130, and the raised use position 226 shown in FIG. 9 where the platform 122 extends generally outwardly from the longitudinally extending bar 130 to support the upper body of the patient 40 with the patient's back arched forwardly as shown in FIG. 1. The platform 122 includes a generally rectangular surface 238, longitudinally extending sides 240, 242 and transversely extending ends 244, 246. The platform 122 is attached to a pair of longitudinally spaced hinges 254, 256 along one side 242 thereof. As shown in broken lines in FIGS. 8 and 9 and in solid lines in FIG. 10, the longitudinally extending bar 130 extends through the hinges 254, 256 to pivotally couple the platform 122 to the longitudinally extending bar 130 between the stowed position 224 and the raised use position 226. The hinge 256 includes a body 258 wrapped around the longitudinally extending bar 130, and a longitudinally extending notch 260 that extends inwardly from an outer end 262 thereof.

Figure 10:
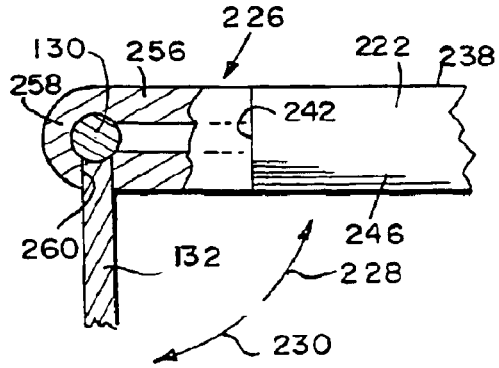
FIG. 10 is a partial sectional end view showing the upper body support platform locked in the horizontal outwardly extending use position.

When the upper body support 100 is in the intermediate use position 112 shown in FIG. 4 and the platform 122 is in the stowed position 224 shown in FIG. 8, the platform 122 and the brace 132 extend generally vertically from the longitudinally extending bar 130, and the notch 260 in the hinge 256 extends generally horizontally and inwardly from the bar 130. When the platform 122 is pivoted about the longitudinally extending bar 130 in direction 228 to the raised use position 226 where it extends generally horizontally therefrom, the notch 260 extends generally vertically and downwardly from the bar 130 as shown in FIG. 9. To lock the platform 122 in the generally horizontal use position 226, the platform 122 is first pivoted about the bar 130 in direction 228 to the generally horizontal position and then translated longitudinally along the bar 130 in direction 266 until the vertically extending brace 132 is received in the notch 260 in the hinge 256 as shown in FIG. 10. To return the platform 122 to the stowed position 224 shown in FIG. 8, the platform 122 is translated along the bar 130 in direction 264 until the notch 260 clears the vertical brace 132. The platform 122 is then pivoted downwardly in direction 230 to the stowed position 224 in FIG. 8.

Thus, to position the patient 40 for receipt of the epidural procedure as shown in FIG. 1, the platform 122 is moved to the raised use position 226 where the platform 122 extends horizontally and outwardly from the bar 130 so that the patient's upper body can rest on the platform 122 with the patient's back arched forwardly, and the patient's feet can extend through the open space 138 formed by the frame 120 to rest on the foot support 300. When the upper body support 100 is in the intermediate use position 112 and the platform 122 is in the vertical stowed position 224 as shown in FIGS. 2 and 4, the platform 122 extends vertically downwardly from the bar 130 to block a portion of the open space 138 to prevent movement of the patient's legs through the open space 138. The platform 122 can be locked in place in its vertical stowed position 224 by any conventional means, such as a latch. The construction and operation of the upper body support 102 on the second side 32 of the patient support 20 is similar.

Figure 12:
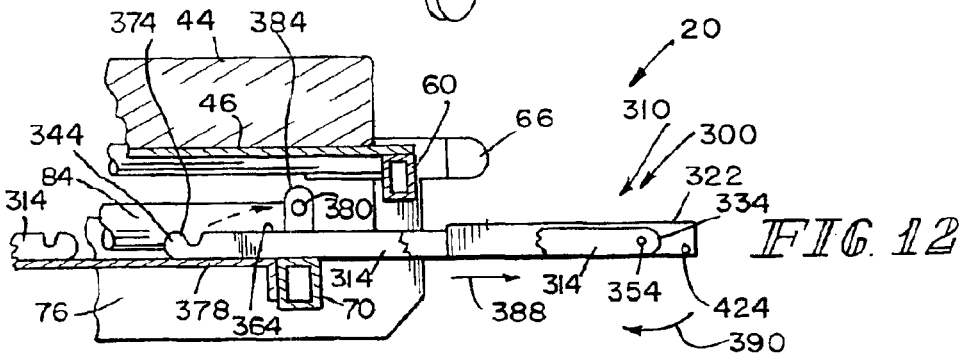
FIGS. 12 and 13 are partial sectional end views of the patient support of FIG. 1, and showing the foot support in an outwardly extending position and a use position, respectively.
Figure 13:
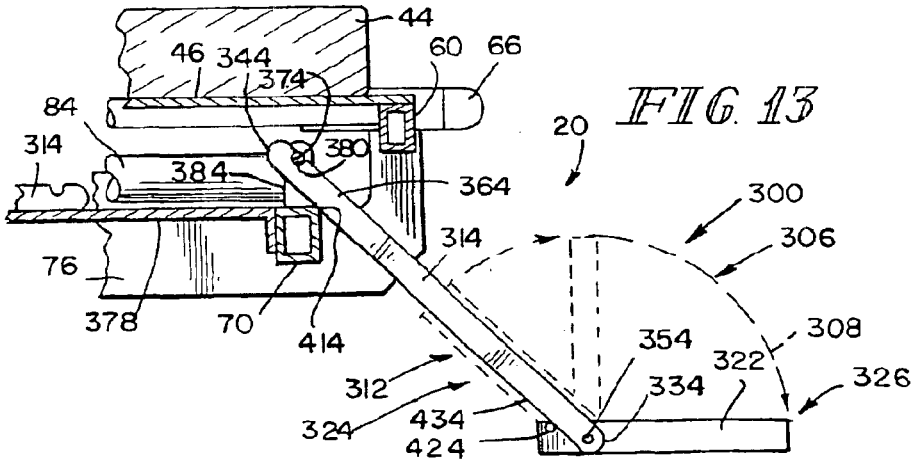
Figure 14:
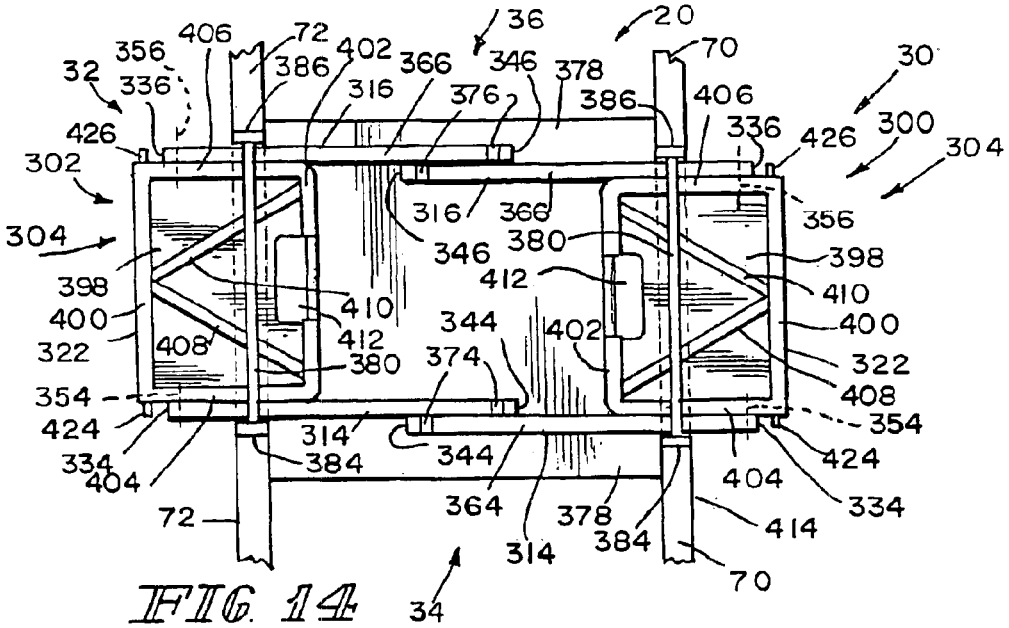
FIG. 14 is a partial top view of the patient support of FIG. 1 with the mattress removed, and with both the foot supports being shown in the storage position.
Figure 15:
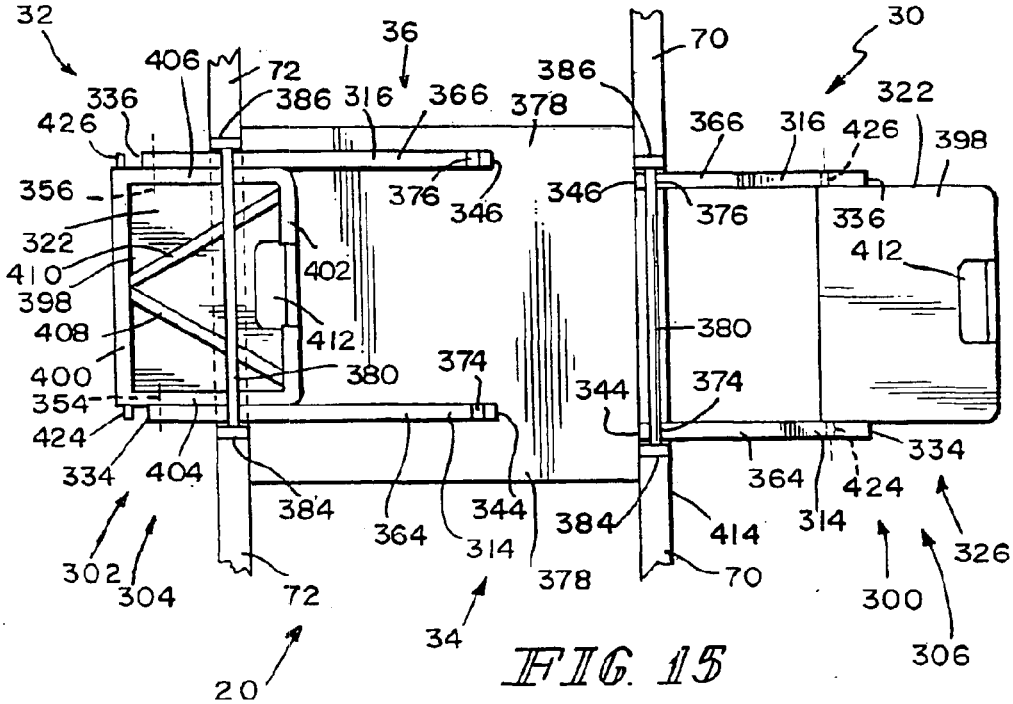
FIG. 15 is another partial top view similar to FIG. 14, and showing one foot support in the storage position and the other in the use position.

Referring to FIGS. 11–15, the foot supports 300, 302 are slidably mounted under the deck 46 for transverse motion between the upper frame 48 and the intermediate frame 50 between a storage position 304 under the deck 46 as shown by broken lines in FIG. 11 and an interim position 310 extending outwardly from the deck 46 as shown by solid lines in FIG. 11. The foot support 300 on the first side 30 of the patient support 20 will be described hereinafter. The construction and operation of the foot support 302 on the second side 32 of the patient support 20 is similar. The foot support 300 includes two transversely extending rails 314, 316 (collectively referred to as a slide) and a swingable foot support platform 322 pivotally mounted to the rails 314, 316 for motion between a stowed position 324 shown by broken lines in FIG. 13 and an outwardly extending use position 326 shown by solid lines in FIG. 13. The rails 314, 316 have outer ends 334, 336 and inner ends 344, 346 respectively. As shown in FIGS. 14 and 15, the platform 322 is attached to the outer ends 334, 335 of the rails 314, 316 for pivotal movement about a pair of transversely extending pins 354, 356 between the stowed position 324 and the use position 326 extending horizontally and outwardly from the rails 314, 316. The top wall 364 of the rail 314 includes a notch 374 adjacent to its inner end 344. Similarly, the top wall 366 of the rail 316 includes a notch 376 adjacent to its inner end 346.

As shown in FIGS. 12–15, a transversely extending cross plate 378 extends between the longitudinally extending side bars 70, 72 of the intermediate frame 50 for slidably supporting the rails 314, 316. A longitudinally extending rod 380 is supported by a pair of brackets 384, 386 mounted on the side bar 70. The rod 380 is sized to be received in the notches 374, 376 in the rails 314, 316 when the rails 314, 316 are pulled out from under the deck 46 in direction 388 to the interim position 310 as shown in FIG. 12, and pivoted downwardly in direction 390 to an intermediate use position 312 as shown by broken lines in FIG. 13.

Referring to FIGS. 14 and 15, the platform 322 comprises a generally rectangular panel 398, longitudinally extending sides 400, 402 and transversely extending ends 404, 406. The platform 322 includes a pair of reinforcing braces 408, 410 on the underside of the panel 398. The panel 398 includes a cutout 412 adjacent to the inner side 402 of the platform 322, so that a caregiver can grip the inner side 402 of the platform 322 and pivot it in direction 308 from the stowed position 324 to the use position 326 as shown in FIG. 13.

Thus, to move the foot support 300 to the use position 306 shown in FIG. 1, the rails 314, 316 are pulled out in direction 388 from under the deck 46 to the interim position 310 as shown in FIG. 12. The rails 314, 316 are then pivoted in direction 390 to the intermediate use position 312 until the longitudinally extending rod 380 is captured in the notches 374, 376 in the rails 314, 316 as shown in FIG. 13. The rails 314, 316 pivot about an outer top edge 414 of the side bar 70 of the intermediate frame 50 as shown in FIG. 13. The inner side 402 of the platform 322 is then grabbed and the platform 322 is pivoted in direction 308 as shown by broken lines in FIG. 13 to the horizontal outwardly extending use position 306 as shown by solid lines in FIG. 13. Pins 424, 426 are secured to the outer walls of the transversely extending ends 404, 406 of the platform 322 adjacent to the outer side 400 thereof. The pins 424, 426 engage the bottom walls 434, 436 of the rails 314, 316 to limit the pivoting movement of the platform 322. The pins 424, 426 are positioned such that the platform 322 extends generally horizontally for supporting the patient's feet as shown in FIG. 1. The previously described sequence can be reversed to return the foot support 300 to the storage position 304 under the deck 46. The construction and operation of the foot support 302 on the second side 32 of the patient support 20 is similar. The foot supports 300, 302 on the opposite sides 30, 32 of the patient support 20 are off-set relative to each other in the longitudinal direction 38 so that they can be both moved to their respective storage positions 304 under the deck 46 as shown in FIG. 14. The rails 314, 316 can be of any desired length to provide comfortable support to the patient's feet.

Figure 16:
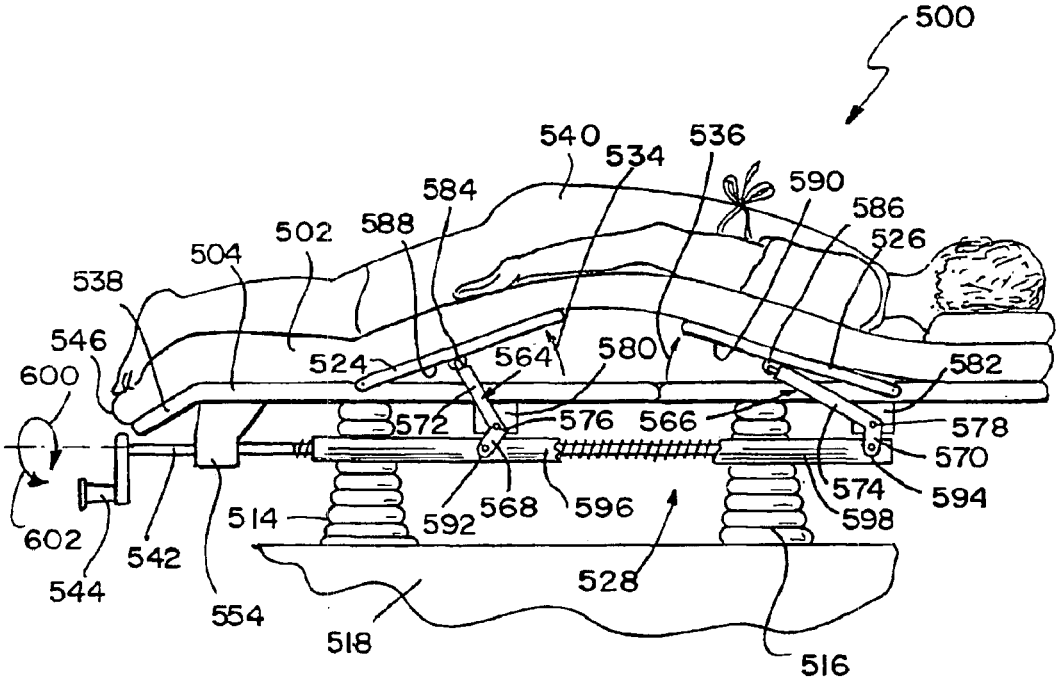
FIG. 16 is a side elevational view of a second embodiment of the patient support, and showing a patient resting on the patient support in a prone position with the patient's back arched upwardly to receive an epidural procedure.

A second embodiment 500 of the illustrative epidural patient support is shown in FIG. 16. The patient support 500 includes a mattress 502 supported on a deck 504 coupled to an upper frame (not shown). The upper frame is supported on a pair of longitudinally spaced lifting mechanisms 514, 516 mounted on a base 518, which, in turn, is supported by a plurality of casters (not shown) on a floor (not shown). The patient support 500 includes two riser panels 524, 526 adjacent to the head end and the foot end of the deck 504 respectively, and a lifting assembly 528 coupled to the riser panels 524, 526 to move each panel 524, 526 between an out-of-the-way lowered position (not shown) and a raised use position indicated by a directional arrows 534, 536. While the panels 524, 526 are pivotally coupled to the underside of the deck 504 in the illustrated embodiment, they may, as well, be coupled to the upper frame or, in the alternative, to an intermediate frame supporting the upper frame. The deck 504 includes a downwardly sloping foot panel 538 to support the feet of a patient 540 lying in a prone position on the mattress 502.

The lifting assembly 528 includes an elongated worm screw 542 having a hand crank 544 attached to its foot end 546. The worm screw 542 is rotatably supported by a bracket 554 coupled to the upper frame. Turning the crank 544 causes the worm screw 542 to move a pair of longitudinally spaced bent links 564, 566. The bent links 564, 566 each have a short portion 568, 570 and a long portion 572, 574. The vertices 576, 578 of the bent links 564, 566 are pivotally coupled to a pair of depending brackets 580, 582 secured to the underside of the deck 504. The brackets 580, 582 may be secured to the upper frame or the intermediate frame, instead of the deck 504. The upper ends 584, 586 of the long portions 572, 574 are configured to engage the undersides 588, 590 of the riser panels 524, 526 to lift the riser panels 524, 526 in response to the rotation of the hand crank 544.

The lower ends 592, 594 of the short portions 568, 570 are movably coupled to the worm screw 542 by nuts 596, 598. As the worm screw 542 is turned in direction 600, the lower ends 592, 594 of the bent links 564, 566 move toward the hand crank 544 near the foot end 546. The long portions 572, 574 are then caused to pivot about vertices 576, 578, moving the riser panels 524, 526 in directions 534, 536 to their respective raised use positions. In contrast, turning the worm screw 542 in the opposite direction 602 causes the long portions 572, 574 of the bent links 564, 566 to pivot in opposite directions to lower the riser panels 524, 526 to their respective out-of-the-way lowered positions.

Although the present invention has been described in detail with reference to certain preferred embodiments, variations and modifications exist within the scope and spirit of the present invention as described above.

What is claimed is:

1. A patient support for placing a patient in a prone position for an epidural procedure with the patient's back arched upwardly, the patient support comprising:

a deck, a mattress supported above the deck, and a contoured portion comprising a first panel and a second panel situated beneath the mattress and overlying the deck, the first and second panels being spaced apart and movable relative to the deck from a lowered position to a raised position to raise the patient's lower back to a desired height relative to the deck so that the patient's back is arched upwardly, a gap being defined between the first and second panels, a portion of the mattress extending across the gap, and the gap being free of any structure that supports the portion of the mattress extending across the gap when the first and second panels are in the raised position.

2. The patient support of claim 1, wherein the first and second panels are horizontal when in the lowered position and the first and second panels are inclined when in the raised position.

3. The patient support of claim 1, wherein the first and second panels are pivotably coupled to the deck.

4. The patient support of claim 3, wherein the first and second panels are lockable in a plurality of positions between the lowered position and the raised position.

5. The patient support of claim 1, wherein the first and second panels move in unison to elevate the patient's back to a desired height relative to the deck to arch the patient's back upwardly.

6. The patient support of claim 1, wherein the deck includes a downwardly sloping foot panel to support the feet of a patient lying in a prone position on the mattress.

7. The patient support of claim 1, further comprising a lifting assembly operable to move the first and second panels between the lowered and raised positions, the lifting assembly having a hand crank that is rotated to operate the lifting assembly.

8. The patient support of claim 1, further comprising a worm screw, a first nut coupled to the worm screw, a second nut coupled to the worm screw, a first link coupled to the first nut, and a second link coupled to the second nut, rotation of the worm screw moving the first and second nuts along the worm screw, and movement of the first and second nuts along the worm screw being transferred via the first and second links to the first and second panels to move the first and second panels.

9. The patient support of claim 8, wherein each of the first and second links are bent, each of the first and second links have a short portion and a long portion coupled together at a vertex, and the vertices of the first and second links are pivotably coupled to the deck.

10. The patient support of claim 9, wherein the short portion of the first link is pivotably coupled to the first nut and the short portion of the second link is pivotably coupled to the second nut.

11. The patient support of claim 9, wherein the vertices of the first and second links are pivotably coupled to the deck via a first bracket and a second bracket, respectively.

12. The patient support of claim 9, wherein the first panel has a first undeside, the second panel has a second underside, and the long portions of the first and second links are configured to engage the first and second undersides of the first and second panels, respectively.

13. The patient support of claim 9, further comprising a hand crank that is coupled to the worm screw and that is turned to rotate the worm screw.

14. The patient support of claim 9, wherein the worm screw is located beneath the deck.

15. The patient support of claim 9, wherein the worm screw is parallel with the deck.

16. The patient support of claim 1, wherein the gap between the first and second panels increases as the first and second panels are moved from the lowered position to the raised position.

* * * * *